United States Patent [19]

Smith

[11] Patent Number: 4,781,306

[45] **Date of Patent: * Nov. 1, 1988**

[54] STACK OF SHEET MATERIAL

[75] Inventor: Daniel D. Smith, Cottage Grove, Minn.

[73] Assignee: Minnesota Mining and Manufacturing Company, St. Paul, Minn.

[ * ] Notice: The portion of the term of this patent subsequent to Nov. 22, 2000 has been disclaimed.

[21] Appl. No.: 529,972

[22] Filed: Sep. 7, 1983

Related U.S. Application Data

[63] Continuation of Ser. No. 235,842, Feb. 19, 1981, Pat. No. 4,416,392.

[51] Int. Cl.[4] ..... B65H 1/00

[52] U.S. Cl. ..... 221/33; 221/45; 206/39.7; 428/206

[58] Field of Search ..... 206/39.3, 39.7, 39.8, 206/39; 221/26, 22, 33, 45, 46, 56, 58, 59, 198; 312/50, 60, 61; 428/201, 206

[56] References Cited

U.S. PATENT DOCUMENTS

| | | | |
|---|---|---|---|
| 442,214 | 12/1880 | Allen | 221/26 |
| 3,370,747 | 2/1968 | Desmond | 221/26 |
| 3,425,595 | 2/1969 | Shapira | 221/59 |
| 4,191,306 | 3/1980 | Rabner | 206/39.7 |
| 4,416,392 | 11/1983 | Smith | 221/45 |

FOREIGN PATENT DOCUMENTS

| | | | |
|---|---|---|---|
| 1472403 | 5/1977 | United Kingdom | 428/304.4 |

*Primary Examiner*—H. Grant Skaggs
*Attorney, Agent, or Firm*—Donald M. Sell; John C. Barnes

[57] ABSTRACT

A stack of flexible sheet material for use in a dispensing device for dispensing individual sheets. The sheets are stacked with alternately opposite edges of successive sheets coated along one edge with a narrow band of readily releasable repositionable pressure-sensitive adhesive. The dispenser comprises a container having a pair of sidewalls connected by a top wall which is formed with a transversely extending rectangular opening extending in the direction parallel to the sidewalls. The stack of sheets are placed within the dispenser such that upon removing the uppermost sheet in the stack the adhesive coating along one edge of the sheet parallel to the opening and adhered to the free edge of the next sheet in the stack will cause the next sheet in the stack to be withdrawn at that free edge through the dispensing opening upon withdrawal of the adhesive coated edge of the uppermost sheet.

6 Claims, 2 Drawing Sheets

STACK OF SHEET MATERIAL

This is a continuation of application Ser. No. 235,842, filed Feb. 19, 1981, now U.S. Pat. No. 4,416,392.

DESCRIPTION

1. Technical Field

This invention relates to a dispensing device, and more particularly, to a dispensing device for a stack of sheet material with each sheet adhered by a strip of adhesive to the next sheet in the stack.

2. Background Art

Dispensers exist in the prior art for dispensing various types of sheet material and product dispensers most closely related to this invention might include the tissue boxes for facial tissue which provide a pop-up dispensing operation such that removal of one tissue will bring the next tissue to the surface. Furthermore, there are dispensers for stamps adhered by a perforated cut which draw fan folded stamps successively out of the dispenser such that they can be withdrawn and separated one at a time, leaving a single stamp projecting from the dispenser. One such stamp dispenser is illustrated in U.S. Pat. No. 4,191,306, which issued on May 4, 1980, to W. P. Rabner.

The dispenser of the present invention differs however in that the product is different and the dispenser is different. The invention is directed to a sheet dispensing. apparatus and sheets upon which a strip of readily releasable pressure sensitive adhesive is adhered to afford withdrawal of the second sheet upon dispensing the top sheet. The adhesive on the dispensed sheet then permits the sheet to be repositioned on another sheet for the purpose of applying a note or receiving staples as will hereinafter be explained. A dispenser for adhesive-coated notepaper or staple-supporting strips makes the dispensing of these sheet like articles much more convenient and part of the convenience results from having the next sheet disposed in a position to be readily grasped. Such a dispensing device is not taught by the prior art known to applicant.

DISCLOSURE OF INVENTION

This invention relates to a dispensing device for use in dispensing sheets which are coated adjacent one edge with a narrow band of readily releasable repositionable pressure-sensitive adhesive and the sheets are stacked with the adhesive coated edge of each successive sheet disposed along alternate opposite edges to maintain the sheets in a stack. The preferred pressure-sensitive adhesive is an acrylate copolymer microsphere structured adhesive coated on the sheets. The dispenser comprises a container having a pair of side walls connected by a top wall, the top wall having a rectangular opening therein extending transversely thereof and parallel to the side walls. The top wall adjacent each of the sidewalls sufficiently covers the edges of the sheets which are coated with a pressure-sensitive adhesive to permit the top sheet to be removed and the next sheet to buckle in the middle enough for the edge thereof, attached adhesively to the sheet being dispensed, to be drawn through the opening The separated sheet is then stripped or peeled from the next or second sheet of the stack. A platform may be utilized below a stack of sheets for urging the sheets towards the dispensing opening.

BRIEF DESCRIPTION OF THE DRAWING

The present invention will be more fully understood after reading the following detailed description which refers to the accompanying drawing wherein.

BEST MODE FOR CARRYING OUT THE INVENTION

This invention provides a novel dispenser for sheet material which is placed in a stack such that upon dispensing of one sheet of the material the next adjacent sheet in the stack will be positioned so that it is separated from the other sheets in the stack and more readily grasped for release from the dispenser. This dispenser is particularly useful for dispensing sheets which are coated with a narrow band of adhesive near one edge such that they are adhered and when one sheet is withdrawn from the stack, the adhesion on the edge of that sheet pulls the free edge of the next sheet from the dispenser. The dispenser is useful for sheets of notepaper and for sheets of polymeric film. The notepaper with its adhesive makes it easy to apply the note to a reception surface. The polymeric sheets which are referred to are useful for supporting a staple on sheets of paper stapled together and the same sheet or tab affords means for readily releasing the staple from the sheets and retaining the staples with the polymeric tab such that they may be disposed of without picking them up individually from the desk, clothing, carpet, or equipment in the area in which the staple has been removed. Polymeric tabs useful for supporting staples and which permit the removal of the staple are disclosed in detail in copending U.S. application, Ser. No. 226,114, filed in the names of Molenda and Rabuse on Jan. 19, 1981, and assigned to the assignee of this application, now U.S. Pat. No. 4,382,326.

Figure 1:
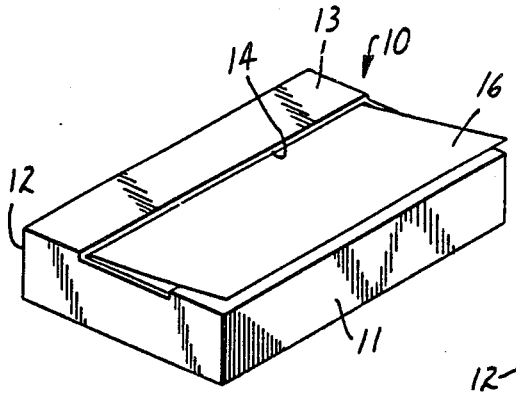
FIG. 1 is a perspective view of a sheet dispenser for notepaper.
Figure 3:
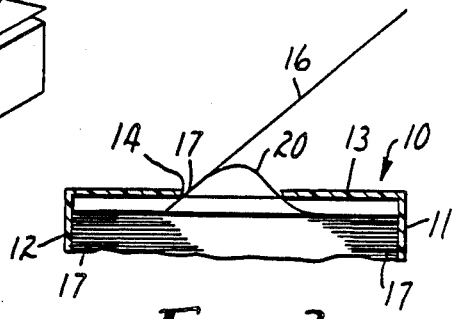
FIGS. 3, 4 and 5 are diagrammatic sectional views showing a sheet being withdrawn and the free end of the next sheet being dispensed.
Figure 2:
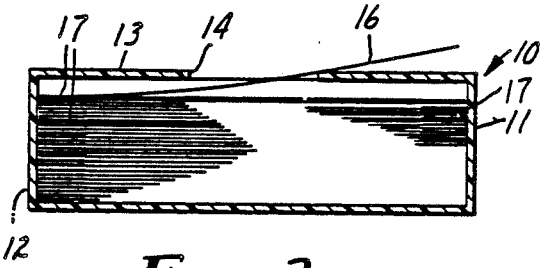
FIG. 2 is a cross-sectional view of the sheet dispenser of FIG. 1.
Figure 4:
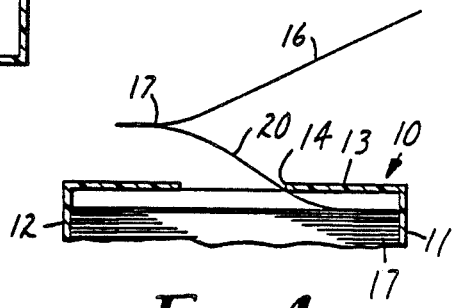
Figure 5:
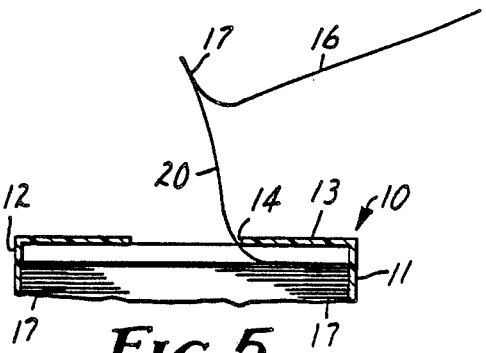

The dispenser of this invention with the material dispensed therefrom is illustrated in the drawing. As noted in FIG. 1, the dispenser 10 comprises a pair of sidewalls 11 and 12 with a top wall 13. The top wall 13 is formed with a rectangular opening 14 extending transversely of the top wall in a direction parallel to the sidewalls which divide the top wall into two symmetrical portions. The opening 14 in the top wall 13 extends a distance equal to or greater than the similar corresponding dimension of the sheet material stacked in the dispenser. A free end of the top sheet 16 of the stack of sheets in the dispenser is withdrawn through the opening 14 and thus is disposed in a position where it may be grasped and separated from the remainder of the sheets in the stack. The free edge of sheet 16 is out of the dispenser and the sheet is coated on an edge thereof remaining in the dispenser with a narrow band of adhesive as illustrated at 17. The band of adhesive is on the alternately opposite edges of successive sheets adjacent the sidewalls. As shown in FIGS. 2, 3, 4 and 5, the free end of the sheet 16, is disposed through the opening 14. When this free end is grasped and pulled in a direction to dispense the sheet, the adhesive 17 pulls the adjacent edge of the next sheet 20 from the stack and brings this adjacent free edge of the next sheet through the opening 14 to the position as shown in FIG. 3. Upon withdrawing the entire sheet 16 and the free edge of the sheet 20 through the opening as shown in FIG. 4, the sheet 16 is separated from the sheet 20 by peeling the sheets apart. Sheet 16 and the coating of adhesive 17 are released from the sheet 20. Sheet 20 now has a free edge extending from the opening 14 of the dispenser so that it may be readily grasped for use, and upon so doing, the other edge of the sheet 20 will be withdrawn from the dispenser through the opening 14, and the edge of the next sheet in the stack will be withdrawn also through the opening due to the adhesive 17 along one edge of the sheet 20 being adhered to the adjacent edge of the next sheet in the stack.

The sheets 16 and 20 may be sheets of paper suitable for notes such as sheets that are 3 inches by 5 inches, 3 inches by 1½ inches, or any other desired size. These sheets are preferably stacked such that the position of the adhesive coating on the under surface of each sheet alternates through the stack of sheets.

Figure 6:
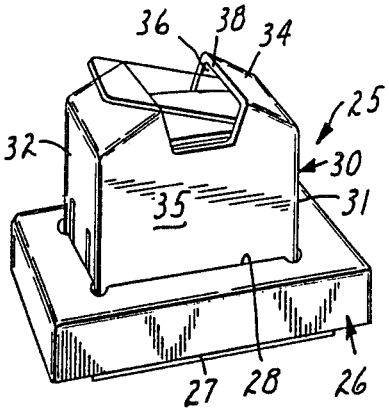
FIG. 6 is a perspective view of a second embodiment of a sheet dispenser for sheets of staple supporting film.
Figure 7:
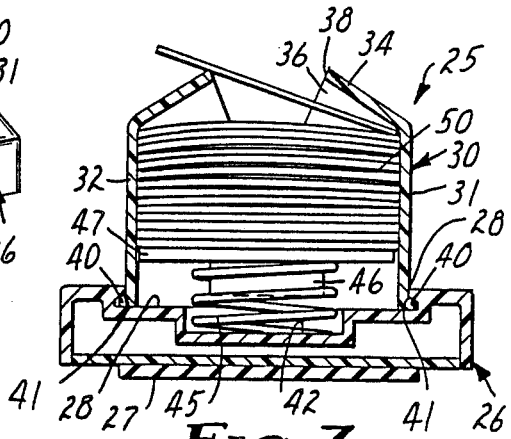
FIG. 7 is a cross-sectional view of the dispenser of FIG. 6.
Figure 8:
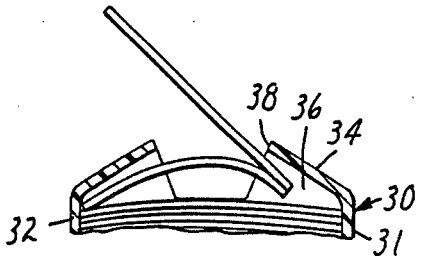
FIGS. 8, 9 and 10 are diagrammatic sectional views of the operation of the dispenser of FIG. 6 while dispensing one sheet.
Figure 9:
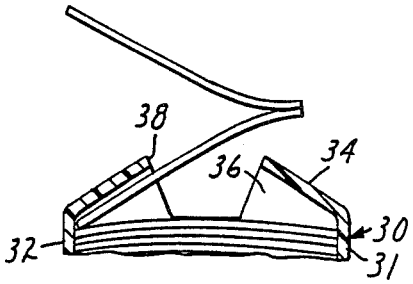
Figure 10:
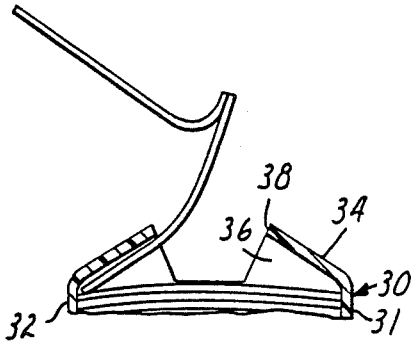

Referring now to FIG. 6 there is illustrated a sheet dispensing device which may be refilled with sheets upon dispensing of the entire stack of sheets. This dispenser may find use with shorter-width sheets and may be refilled with a stack of sheets where the sheets are alternately stacked such that the adhesive coated edges are disposed against both sidewalls of the dispenser. As illustrated in FIG. 6, the dispenser 25 comprises a base 26 having a top surface and a bottom which has a pad 27 thereon which pad may be a protective pad or a rubber-like pad to increase the friction between the base 26 and a support surface such as a desk top. Preferably, the base 26 is hollow and filled, as with sand to be weighted such that its stability is improved and the dispenser is restricted from sliding when sufficient force is applied to the sheet to dispense the sheet. The top surface of the base has a recess 28. Mounted on the base 26 in recess 28, and removable therefrom, is a cover 30 having sidewalls 31 and 32 and a top wall 34 with end walls 35 and 36. An opening 38 is formed in the top wall and separates two inclined portions of the top wall 34 to define the dispensing opening. The sidewalls 31 and 32 are provided with tabs 40 which serve as securing means to secure the sidewalls of the dispenser beneath detents 41 formed in the recess 28 of the base. The base is also formed with a central recessed opening 42 in the recess 28 which receives one end of a helical compression spring 45. The other end of this compression spring is supported by a stud 46 of a table or platform 47 which is movable vertically in the cover 30 between the sidewalls 31 and 32 toward the top wall 34 to urge the stack of sheets 50 toward the top wall 34. The sheets in the stack are positioned with the adhesive along alternate edges of adjacent sheets. The adhesive side down in all instances.

The top wall 34 is symmetrical and covers the opposite edges of the 5 sheets 50 and diverges from the opening 38 toward the sidewalls 31 and 32. These inclined portions of the top wall 34 provide a surface disposed below the edge of the sheets 50 which extend through the dispensing opening 38. Due to the incline, the sheets may be more readily grasped than if the edges of the top wall 34 were perpendicular to the sidewalls 31 and 32 as illustrated in FIGS. 1 through 5.

The preferred pressure-sensitive adhesive for the sheets is an acrylate copolymer microsphere structured adhesive as disclosed in U.S. Pat. Nos. 3,691,140 issued to Silver on Mar. 3, 1970 and 3,857,731 issued to Merrill et al on Apr. 6, 1973, and assigned to the assignee of this application. This type adhesive allows for the removal or separation of the sheets and the repositioning of the dispensed sheets on different receptor surfaces without injury to the surfaces.

Having disclosed a preferred embodiment of the present invention together with modifications thereof it is to be understood that further modifications of this dispenser may be made without departing from the scope and the spirit of the invention as recited in the attached claims.

I claim:

1. A stack of flexible sheet material comprising a plurality of sheets disposed one on top of another, each sheet having a band of relatively releasable repositionable adhesive coated along one edge thereof and the sheets are stacked with the adhesive coated edge of each successive sheet disposed along alternate opposite edges to maintain the sheets in said stack.

2. A stack of flexible sheet material according to claim 1 wherein said sheets are sheets of paper.

3. A stack of flexible sheet material according to claim 1 wherein said sheets are sheets of polymeric film.

4. A stack of flexible sheet material according to claim 2 wherein said adhesive is an acrylate copolymer microsphere structured pressure-sensitive adhesive.

5. A stack of flexible sheet material according to claim 3 wherein said adhesive is an acrylate copolymer microsphere structured pressure-sensitive adhesive.

6. A stack of flexible sheet material according to claim 1 wherein said adhesive is an acrylate copolymer microsphere structured pressure-sensitive adhesive.

* * * * *